US009745999B2

(12) United States Patent
Beers et al.

(10) Patent No.: US 9,745,999 B2
(45) Date of Patent: Aug. 29, 2017

(54) COMPRESSOR DIFFUSER AND SHROUD FOR A MOTOR DRIVEN COMPRESSOR

(71) Applicant: Hamilton Sundstrand Corporation, Windsor Locks, CT (US)

(72) Inventors: Craig M. Beers, Wethersfield, CT (US); Darryl A. Colson, West Suffield, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 405 days.

(21) Appl. No.: 14/603,559

(22) Filed: Jan. 23, 2015

(65) Prior Publication Data

US 2016/0215791 A1 Jul. 28, 2016

(51) Int. Cl.

| | |
|---|---|
| ***F04D 29/44*** | (2006.01) |
| ***F04D 17/12*** | (2006.01) |
| ***F04D 25/06*** | (2006.01) |
| ***F04D 29/08*** | (2006.01) |
| ***F04D 29/62*** | (2006.01) |

(52) U.S. Cl.

CPC ..... *F04D 29/441* (2013.01); *F04D 17/12* (2013.01); *F04D 25/06* (2013.01); *F04D 29/083* (2013.01); *F04D 29/624* (2013.01)

(58) Field of Classification Search

CPC ..... F04D 17/12; F04D 29/083; F04D 29/441; F04D 29/624; B64D 13/00

See application file for complete search history.

(56) References Cited

U.S. PATENT DOCUMENTS

| | | | | | |
|---|---|---|---|---|---|
| 2,114,285 | A * | 4/1938 | Berger | F04D 29/444 | 29/889.4 |
| 3,761,205 | A * | 9/1973 | Cronstedt | F02C 3/113 | 415/122.1 |
| 3,853,432 | A * | 12/1974 | Cronstedt | F02C 3/113 | 415/122.1 |
| 3,904,308 | A * | 9/1975 | Ribaud | F04D 21/00 | 415/143 |
| 3,953,147 | A * | 4/1976 | Aspinwall | F04D 25/16 | 415/143 |
| 4,212,585 | A * | 7/1980 | Swarden | F04D 27/0215 | 415/198.1 |
| 4,344,737 | A * | 8/1982 | Liu | F04D 29/441 | 415/199.1 |
| 5,423,304 | A * | 6/1995 | Lawrence | F02B 33/40 | 123/559.1 |

(Continued)

*Primary Examiner* — Woody Lee, Jr.
(74) *Attorney, Agent, or Firm* — Cantor Colburn LLP

(57) ABSTRACT

An aspect includes a compressor diffuser and shroud for a motor driven compressor assembly. The motor driven compressor assembly includes a first stage compressor and a second stage compressor. The compressor diffuser and shroud of the second stage compressor includes a diffuser portion and a shroud portion. The diffuser portion includes a diffuser portion outer lip having a first sealing lip outer diameter to provide a first sealing interface to a second stage compressor housing. The shroud portion includes a curvature between the diffuser portion outer lip and a compressor inlet to align with a second stage compressor rotor, where a ratio of the first sealing lip outer diameter to an innermost diameter of the compressor diffuser and shroud is between 2.698 and 2.711.

15 Claims, 5 Drawing Sheets

(56) References Cited

U.S. PATENT DOCUMENTS

| | | | | |
|---|---|---|---|---|
| 8,475,114 | B2 * | 7/2013 | Rosen | F16C 3/02 29/889.1 |
| 8,556,516 | B2 * | 10/2013 | Beers | F04D 17/12 384/317 |
| 2005/0039334 | A1 * | 2/2005 | Roby | B22C 9/04 29/889.21 |
| 2006/0117956 | A1 | 6/2006 | Schwalm | |
| 2011/0229313 | A1 * | 9/2011 | Beers | B64D 13/06 415/180 |
| 2012/0156018 | A1 | 6/2012 | Rosen et al. | |
| 2014/0080397 | A1 | 3/2014 | Surawski | |
| 2014/0321979 | A1 * | 10/2014 | Beers | F01D 5/288 415/115 |
| 2016/0076554 | A1 * | 3/2016 | Rosen | F04D 29/444 415/207 |
| 2017/0022999 | A1 * | 1/2017 | Peer | F04D 29/0516 |
| 2017/0108031 | A1 * | 4/2017 | Beers | F16C 3/02 |

* cited by examiner

COMPRESSOR DIFFUSER AND SHROUD FOR A MOTOR DRIVEN COMPRESSOR

BACKGROUND OF THE INVENTION

The subject matter disclosed herein relates generally to compressors and, more particularly, to a compressor diffuser and shroud for a motor driven compressor of an aircraft inert gas generating system.

Aircrafts generally include various systems for generating inert gas to control fuel tank flammability. These systems include, for example, a nitrogen generation system that serves to generate the inert gas. Typically, such a nitrogen generation system has a motor that is coupled to one or more compressor stages to remove air from the cabin, to drive the removed air into a heat exchanger and to continue to drive the removed air toward an exhaust system. The motor and compressor stages are collectively referred to as a motor driven compressor.

The process of assembling a motor driven compressor is typically time and labor intensive, as proper alignment and clearance of rotating parts must be achieved. As one example, a typical assembly process includes an initial alignment and bolting together of static parts, followed by drilling and inserting precision-machined alignment pins. After pin placement, the static parts are disassembled, and the motor driven compressor is reassembled including both the static parts and moving parts, where the pins enable precise realignment. This process maintains precise alignment for future maintenance and servicing of the motor driven compressor; however, the initial manufacturing burden is high. Further, static parts must be sized to receive the alignment pins, which can impact system weight and require precise tolerances.

BRIEF DESCRIPTION OF THE INVENTION

According to one aspect of the invention, a compressor diffuser and shroud for a motor driven compressor assembly is provided. The motor driven compressor assembly includes a first stage compressor and a second stage compressor. The compressor diffuser and shroud of the second stage compressor includes a diffuser portion and a shroud portion. The diffuser portion includes a diffuser portion outer lip having a first sealing lip outer diameter to provide a first sealing interface to a second stage compressor housing. The shroud portion includes a curvature between the diffuser portion outer lip and a compressor inlet to align with a second stage compressor rotor, where a ratio of the first sealing lip outer diameter to an innermost diameter of the compressor diffuser and shroud is between 2.698 and 2.711.

According to another aspect of the invention, a method of installing a compressor diffuser and shroud in a motor driven compressor assembly including a first stage compressor and a second stage compressor is provided. The method includes aligning the compressor diffuser and shroud with a thrust plate of the motor driven compressor assembly using a cylindrical alignment tool. The method further includes coupling the compressor diffuser and shroud with the thrust plate based on the aligning to seal a second stage compressor housing with respect to the compressor diffuser and shroud. The compressor diffuser and shroud includes a diffuser portion and a shroud portion. The diffuser portion includes a diffuser portion outer lip having a first sealing lip outer diameter to provide a first sealing interface to the second stage compressor housing. The shroud portion includes a curvature between the diffuser portion outer lip and a compressor inlet to align with a second stage compressor rotor, where a ratio of the first sealing lip outer diameter to an innermost diameter of the compressor diffuser and shroud is between 2.698 and 2.711.

Other aspects, features, and techniques of the invention will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION OF THE INVENTION

Figure 1:
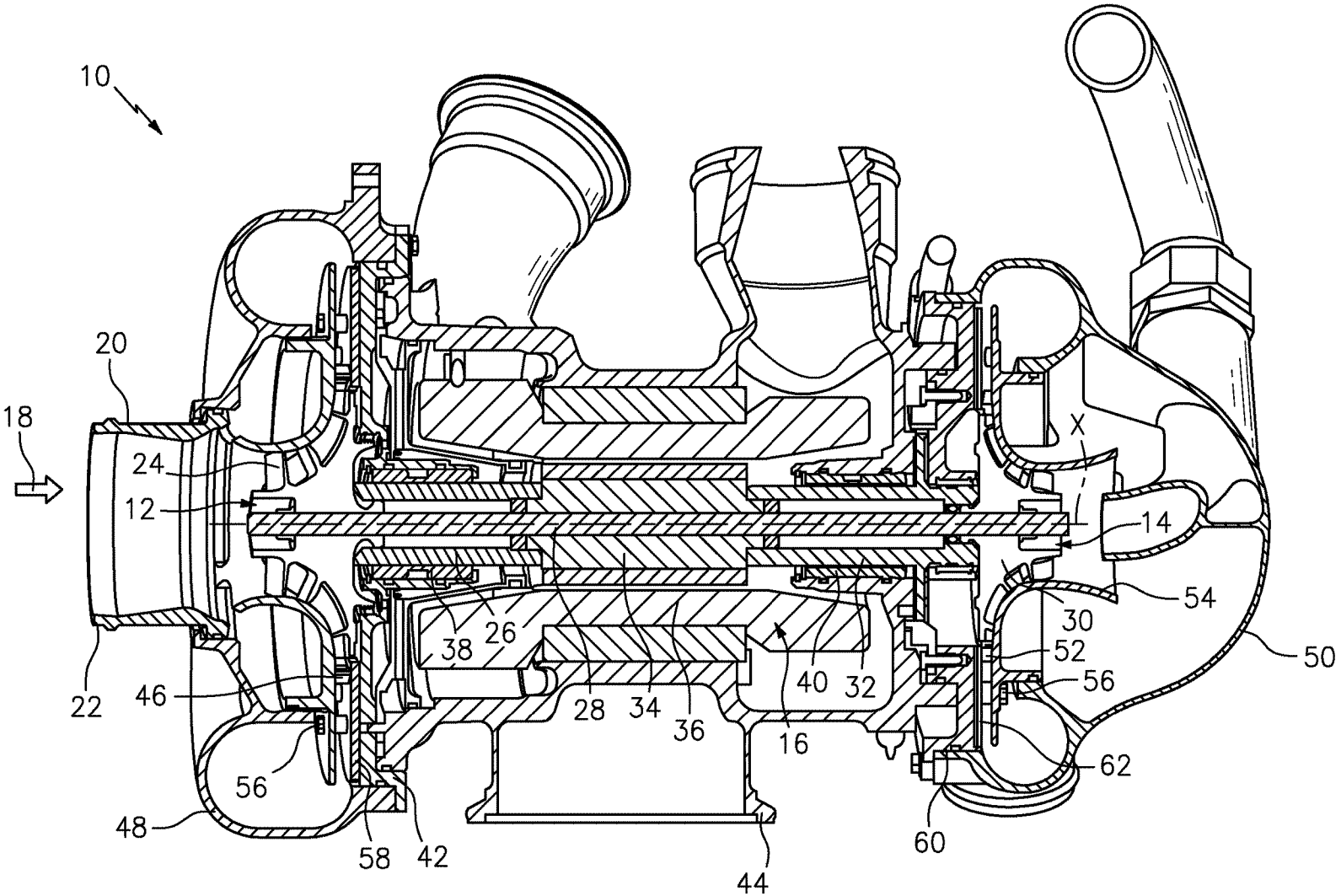
FIG. 1 is a cross-sectional view of a motor driven compressor assembly according to an embodiment of the invention.

Referring to the drawings, FIG. 1 is a cross-sectional view of a motor driven compressor assembly 10, which may be used in an inert gas generation system, such as a nitrogen generation system for an aircraft. The motor driven compressor assembly 10 includes a first stage compressor 12 and a second stage compressor 14 driven by a motor 16. The motor driven compressor assembly 10 compresses air flow 18 that is received at a compressor inlet portion 22 of a compressor diffuser and shroud 20 of the first stage compressor 12. The first stage compressor 12 also includes a first stage compressor rotor 24 that is coupled to a bearing shaft 26 and a tie rod 28 concentrically aligned about an axis of rotation X of the motor driven compressor assembly 10. The tie rod 28 is also coupled to a second stage compressor rotor 30 of the second stage compressor 14. The second stage compressor rotor 30 is further coupled to a thrust shaft 32, where the thrust shaft 32 and the bearing shaft 26 are driven by motor rotor 34 to rotate about the axis of rotation X based on an electrical current applied to motor stator 36 of the motor 16. Journal bearings 38 and 40 support rotation of the bearing shaft 26 and thrust shaft 32 respectively. A bearing support plate 42 aligns journal bearing 38 concentrically with the axis of rotation X. A motor housing 44 aligns journal bearing 40 concentrically with the axis of rotation X, while also containing the motor 16.

In the example of a nitrogen generation system for an aircraft, the air flow 18 may be received from an aircraft cabin and be compressed by the first stage compressor rotor 24, diffused by diffuser fins 46 of the compressor diffuser and shroud 20, routed through a first stage compressor housing 48, passed to a second stage compressor housing 50, and further compressed by the second stage compressor rotor 30 of the second stage compressor 14. Compressed flow of the second stage compressor rotor 30 can be diffused by diffuser fins 52 of a compressor diffuser and shroud 54 of the second stage compressor 14, routed through the second stage compressor housing 50, and provided to an air separation module (not depicted) to extract nitrogen as an inert gas for a cargo area or fuel tanks of an aircraft, for instance.

The compressor diffuser and shroud 20 establishes multiple seals with respect to the first stage compressor housing 48 to contain a compressed flow. The compressor diffuser and shroud 20 can be coupled to the bearing support plate 42 using a plurality of fasteners 56, such as bolts. A compressor backing plate 58 is interposed between the compressor diffuser and shroud 20 and the bearing support plate 42. The second stage compressor housing 50 is sealed with respect to the compressor diffuser and shroud 54 and a thrust plate 60. The compressor diffuser and shroud 54 can be coupled to the thrust plate 60 using a plurality of fasteners 56. A compressor backing plate 62 is interposed between the compressor diffuser and shroud 54 and the thrust plate 60. The compressor backing plates 58 and 62 interface with the diffuser fins 46 and 52 respectively. In order to achieve a high operating efficiency within the motor driven compressor assembly 10, precise sizing and alignment of components of the motor driven compressor assembly 10 must be achieved.

Figure 2B:
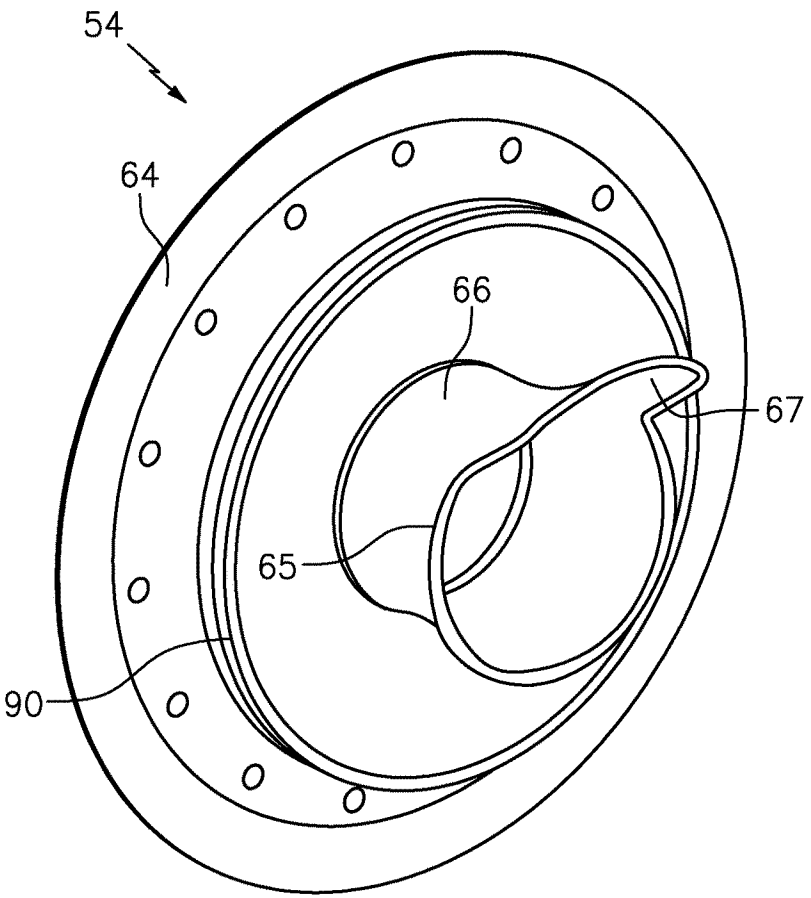
FIG. 2B is another perspective view of the compressor diffuser and shroud of the motor driven compressor assembly of FIG. 1 according to an embodiment of the invention.
Figure 2A:
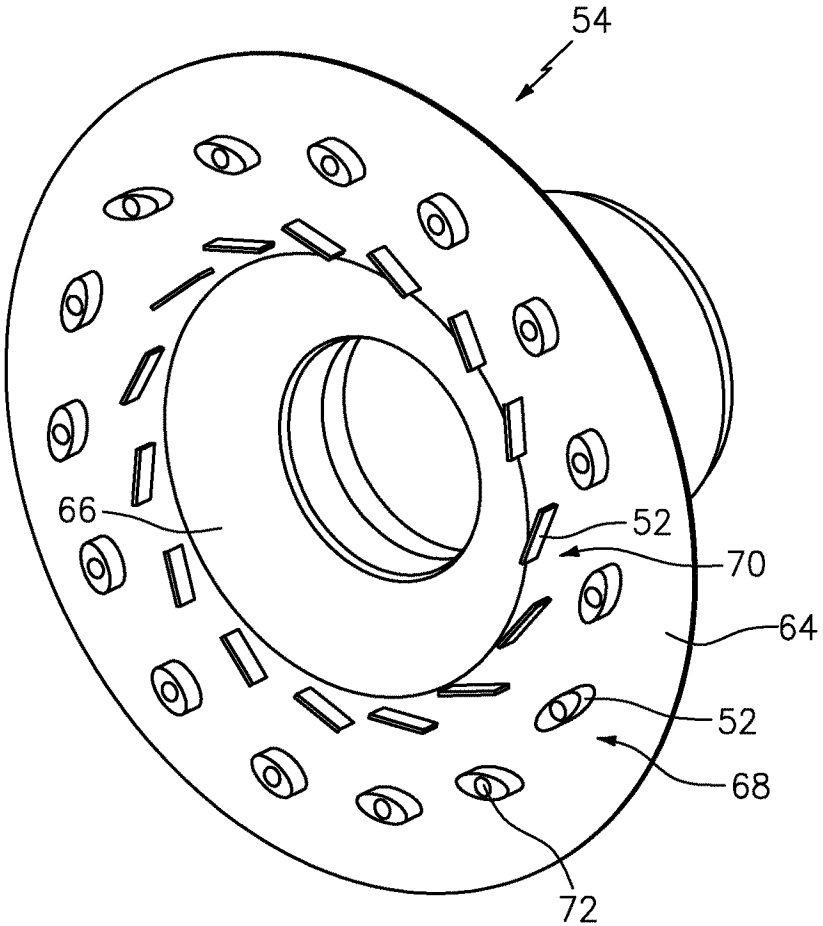
FIG. 2A is a perspective view of a compressor diffuser and shroud of the motor driven compressor assembly of FIG. 1 according to an embodiment of the invention.

FIGS. 2A and 2B are perspective views of the compressor diffuser and shroud 54 of the motor driven compressor assembly 10 of FIG. 1 according to an embodiment. The compressor diffuser and shroud 54 of the second stage compressor 14 of FIG. 1 includes a diffuser portion 64, a compressor inlet 65, and a shroud portion 66. The compressor inlet 65 in the example of FIG. 2B includes an inlet scoop 67 to further condition flow within the second stage compressor housing 50. The diffuser portion 64 includes an outermost group 68 of the diffuser fins 52 and an innermost group 70 of the diffuser fins 52. The outermost group 68 of the diffuser fins 52 includes a plurality of holes 72 to fasten the compressor diffuser and shroud 54 to the thrust plate 60 of the motor driven compressor assembly 10 of FIG. 1. The compressor diffuser and shroud 54 also includes a diffuser portion outer lip 90 to provide a first sealing interface to the second stage compressor housing 50 of FIG. 1.

Figure 3:
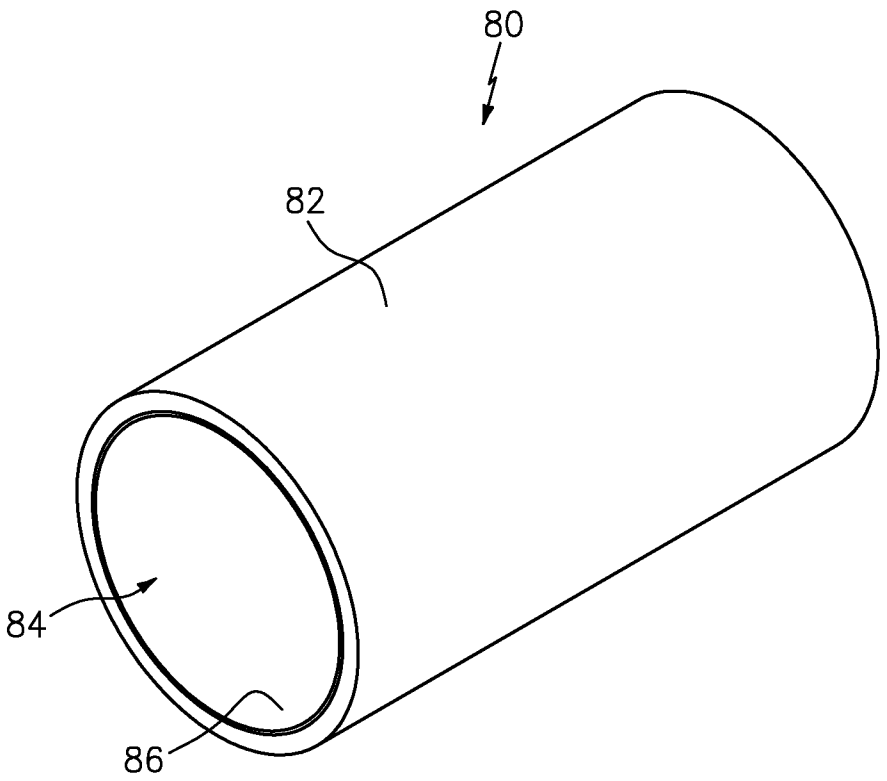
FIG. 3 is a perspective view of a cylindrical alignment tool that can be used to align the compressor diffuser and shroud of FIG. 2 to the motor driven compressor assembly of FIG. 1 during an assembly process according to an embodiment of the invention.

FIG. 3 is a perspective view of a cylindrical alignment tool 80 that can be used to align the compressor diffuser and shroud 54 to the motor driven compressor assembly 10 of FIG. 1 during an assembly process according to an embodiment. The cylindrical alignment tool 80 has a stiff outer portion 82 that can be made from aluminum or similar material. An interior portion 84 of the cylindrical alignment tool 80 can include an inner lining 86 of a compliant material having a relatively low coefficient of friction, such as Teflon, a silicone ring, or similar material. Compliance of the inner lining 86 compensates for slight sizing differences between the compressor diffuser and shroud 54 and the thrust plate 60 of FIG. 1. The cylindrical alignment tool 80 can be used prior to coupling the second stage compressor housing 50 to the compressor diffuser and shroud 54 of FIG. 1 such that the fasteners 56 of FIG. 1 can be installed to couple the compressor diffuser and shroud 54 to the thrust plate 60 of FIG. 1 with precise alignment. Once the fasteners 56 of FIG. 1 are secured, the cylindrical alignment tool 80 is removed from contacting the motor driven compressor assembly 10 of FIG. 1.

Figure 4:
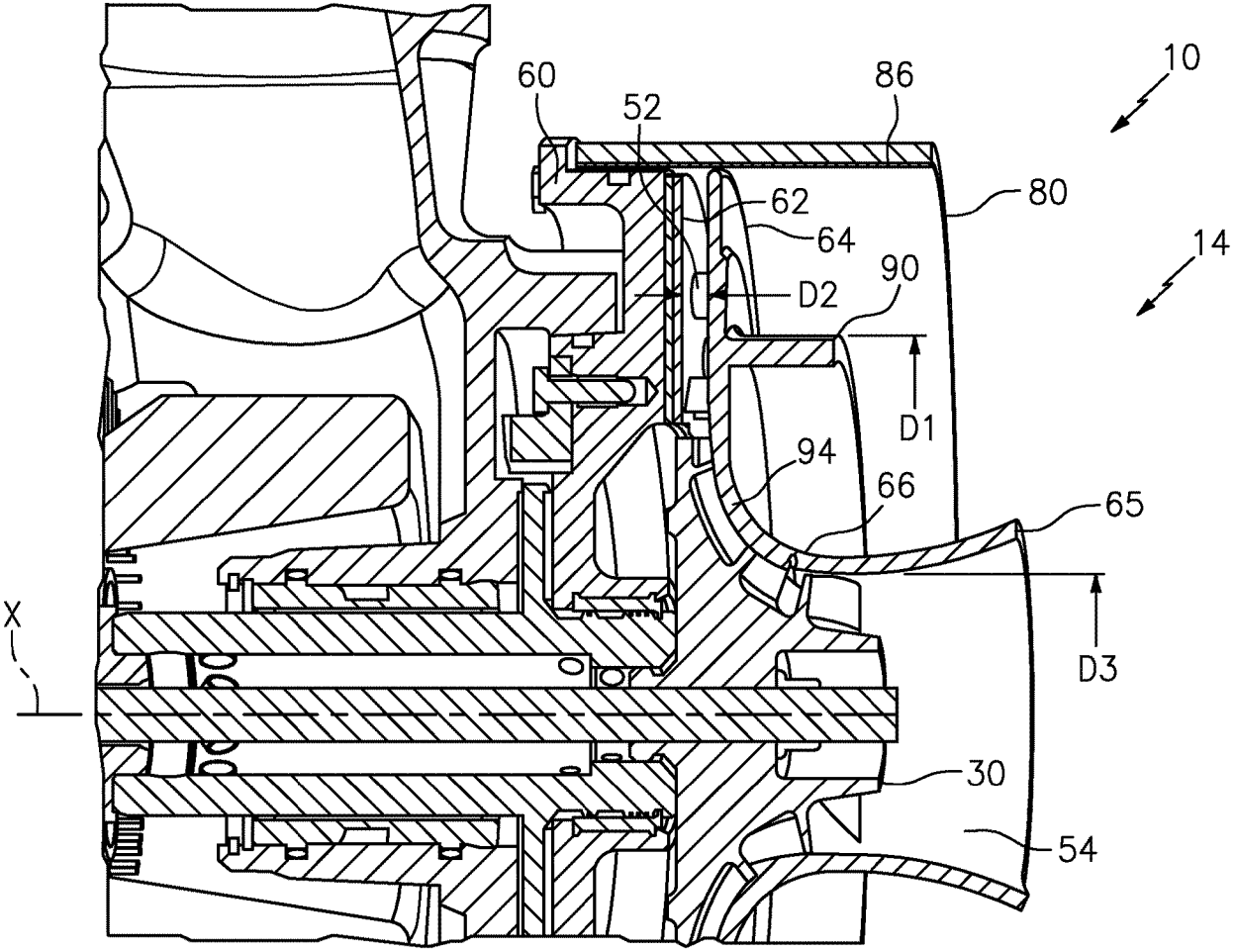
FIG. 4 is a partial perspective view of the motor driven compressor assembly of FIG. 1 during an assembly process according to an embodiment of the invention.
Figure 5:
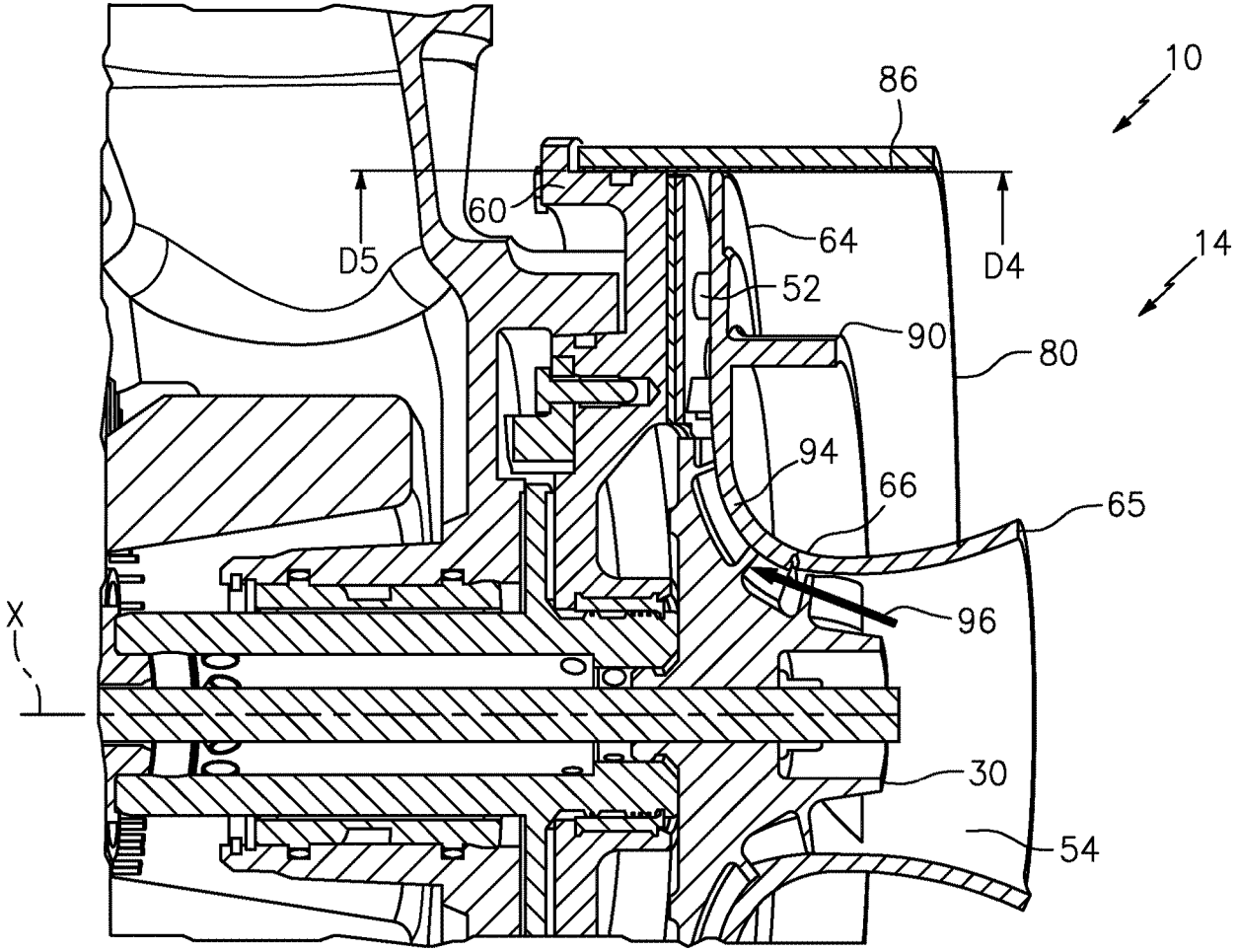
FIG. 5 is another partial perspective view of the motor driven compressor assembly of FIG. 1 during an assembly process according to an embodiment of the invention.

FIGS. 4 and 5 depict a partial perspective view of the motor driven compressor assembly 10 of FIG. 1, as seen during an assembly process according to an embodiment. FIGS. 4 and 5 depict another view of the diffuser portion 64, the compressor inlet 65, and the shroud portion 66 of the compressor diffuser and shroud 54 of the second stage compressor 14. The diffuser portion 64 includes the diffuser portion outer lip 90 having a first sealing lip outer diameter D1 to provide a first sealing interface to the second stage compressor housing 50 of FIG. 1. The shroud portion 66 includes a curvature 94 between the diffuser portion outer lip 90 and the compressor inlet 65 to align with the second stage compressor rotor 30. The diffuser portion 64 includes diffuser fins 52 to diffuse a compressed flow 96 of the second stage compressor 14 with respect to the thrust plate 60.

In an embodiment, the first sealing lip outer diameter D1 is about 4.624 inches (11.745 cm), a height D2 of the diffuser fins 52 is about 0.145 inches (0.368 cm), and an innermost diameter D3 of the compressor diffuser and shroud 54 is about 1.71 inches (4.343 cm). In an embodiment, a ratio of the first sealing lip outer diameter D1 to the innermost diameter D3 of the compressor diffuser and shroud 54 is between 2.698 and 2.711. In an embodiment, a ratio of the first sealing lip outer diameter D1 to the height D2 of the diffuser fins 52 is between 30.21 and 33.78. In an embodiment, a ratio of the innermost diameter D3 of the compressor diffuser and shroud 54 to the height D2 of the diffuser fins 52 is between 11.16 and 12.5. An outermost diameter D4 of the compressor diffuser and shroud 54 is sized to substantially align with an outer diameter D5 of the thrust plate 60 using an interior portion 84 of the cylindrical alignment tool 80.

The cylindrical alignment tool 80 can be used to install the compressor diffuser and shroud 54 in the motor driven compressor assembly 10 by using the interior portion 84 of the cylindrical alignment tool 80 to align the compressor diffuser and shroud 54 with the thrust plate 60 of the motor driven compressor assembly 10. Alignment is performed radially such that the compressor diffuser and shroud 54 and the thrust plate 60 are concentrically aligned with respect to the axis of rotation X of the motor driven compressor assembly 10. As previously described, the compressor backing plate 62 can be interposed between the compressor diffuser and shroud 54 and the thrust plate 60. Alignment of the compressor diffuser and shroud 54 with the thrust plate 60 can also include positioning a plurality of diffuser fins 52 of the diffuser portion 64 to diffuse a compressed flow 96 of the second stage compressor 14 with respect to the thrust plate 60. Upon alignment, the compressor diffuser and shroud 54 is coupled with the thrust plate 60 to seal the second stage compressor housing 50 with respect to the compressor diffuser and shroud 54.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A compressor diffuser and shroud for a motor driven compressor assembly, the motor driven compressor assembly comprising a first stage compressor and a second stage compressor, the compressor diffuser and shroud of the second stage compressor comprising:

a diffuser portion comprising a diffuser portion outer lip having a first sealing lip outer diameter to provide a first sealing interface to a second stage compressor housing; and a shroud portion comprising a curvature between the diffuser portion outer lip and a compressor inlet to align with a second stage compressor rotor, wherein a ratio of the first sealing lip outer diameter to an innermost diameter of the compressor diffuser and shroud is between 2.698 and 2.711.

2. The compressor diffuser and shroud of claim 1, wherein the diffuser portion comprises a plurality of diffuser fins to diffuse a compressed flow of the second stage compressor with respect to a thrust plate.

3. The compressor diffuser and shroud of claim 2, wherein a ratio of the first sealing lip outer diameter to a height of the diffuser fins is between 30.21 and 33.78.

4. The compressor diffuser and shroud of claim 3, wherein a ratio of the innermost diameter of the compressor diffuser and shroud to the height of the diffuser fins is between 11.16 and 12.5.

5. The compressor diffuser and shroud of claim 2, wherein the diffuser portion comprises an outermost group of the diffuser fins and an innermost group of the diffuser fins.

6. The compressor diffuser and shroud of claim 5, wherein the outermost group of the diffuser fins includes a plurality of holes to fasten the compressor diffuser and shroud to the thrust plate of the motor driven compressor assembly.

7. The compressor diffuser and shroud of claim 6, wherein an outermost diameter of the compressor diffuser and shroud is sized to substantially align with an outer diameter of the thrust plate using an interior portion of a cylindrical alignment tool.

8. The compressor diffuser and shroud of claim 6, wherein a compressor backing plate is interposed between the compressor diffuser and shroud and the thrust plate.

9. A method of installing a compressor diffuser and shroud in a motor driven compressor assembly comprising a first stage compressor and a second stage compressor, the method comprising:

aligning the compressor diffuser and shroud with a thrust plate of the motor driven compressor assembly using a cylindrical alignment tool; and coupling the compressor diffuser and shroud with the thrust plate based on the aligning to seal a second stage compressor housing with respect to the compressor diffuser and shroud, the compressor diffuser and shroud comprising:

a diffuser portion comprising a diffuser portion outer lip having a first sealing lip outer diameter to provide a first sealing interface to the second stage compressor housing; and a shroud portion comprising a curvature between the diffuser portion outer lip and a compressor inlet to align with a second stage compressor rotor, wherein a ratio of the first sealing lip outer diameter to an innermost diameter of the compressor diffuser and shroud is between 2.698 and 2.711.

10. The method of claim 9, wherein aligning the compressor diffuser and shroud with the thrust plate further comprises positioning a plurality of diffuser fins of the diffuser portion to diffuse a compressed flow of the second stage compressor with respect to the thrust plate.

11. The method of claim 10, wherein a ratio of the first sealing lip outer diameter to a height of the diffuser fins is between 30.21 and 33.78, and a ratio of the innermost diameter of the compressor diffuser and shroud to the height of the diffuser fins is between 11.16 and 12.5.

12. The method of claim 11, wherein an outermost diameter of the compressor diffuser and shroud is sized to substantially align with an outer diameter of the thrust plate using an interior portion of the cylindrical alignment tool.

13. The method of claim 10, wherein the diffuser portion comprises an outermost group of the diffuser fins and an innermost group of the diffuser fins.

14. The method of claim 13, wherein the outermost group of the diffuser fins includes a plurality of holes to couple the compressor diffuser and shroud to the thrust plate of the motor driven compressor assembly.

15. The method of claim 14, further comprising: interposing a compressor backing plate between the compressor diffuser and shroud and the thrust plate.

* * * * *